US011553827B2

(12) United States Patent
Woo et al.

(10) Patent No.: US 11,553,827 B2
(45) Date of Patent: Jan. 17, 2023

(54) DISHWASHER

(71) Applicant: LG Electronics Inc., Seoul (KR)

(72) Inventors: Sangwoo Woo, Seoul (KR); Minseong Kim, Seoul (KR); Hyungman Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 41 days.

(21) Appl. No.: 17/339,551

(22) Filed: Jun. 4, 2021

(65) Prior Publication Data

US 2021/0290032 A1 Sep. 23, 2021

Related U.S. Application Data

(63) Continuation of application No. 16/118,728, filed on Aug. 31, 2018, now Pat. No. 11,033,171.

(30) Foreign Application Priority Data

Aug. 31, 2017 (KR) ..... 10-2017-0111511

(51) Int. Cl.
*A47L 15/42* (2006.01)

(52) U.S. Cl.
CPC ..... *A47L 15/4234* (2013.01); *A47L 15/4219* (2013.01); *A47L 15/4223* (2013.01); *A47L 15/4214* (2013.01); *A47L 15/4225* (2013.01); *A47L 15/4285* (2013.01); *A47L 2501/03* (2013.01); *A47L 2501/06* (2013.01)

(58) Field of Classification Search
CPC ..... A47L 15/4234
See application file for complete search history.

(56) References Cited

U.S. PATENT DOCUMENTS

| | | | |
|---|---|---|---|
| 4,919,162 | A | 4/1990 | Lumby et al. |
| 2003/0029478 | A1 | 2/2003 | Hegeman |
| 2011/0214702 | A1 | 9/2011 | Brown-West et al. |
| 2012/0279527 | A1 | 11/2012 | Lee et al. |
| 2016/0051122 | A1 | 2/2016 | Lee et al. |

(Continued)

FOREIGN PATENT DOCUMENTS

| | | |
|---|---|---|
| CN | 202843552 | 4/2013 |
| DE | 10157084 | 5/2003 |
| DE | 10260163 | 7/2004 |

(Continued)

OTHER PUBLICATIONS

AU Office Action in Australian Appln. No. 2018223052, dated Feb. 22, 2019, 6 pages.

(Continued)

*Primary Examiner* — Jason Y Ko
(74) *Attorney, Agent, or Firm* — Fish & Richardson P.C.

(57) ABSTRACT

The present disclosure relates to a dishwasher for washing the dishes and the cooking utensils by spraying washing water and steam. The dishwasher according to an embodiment of the present invention includes a tub which accommodates a washing object, a sump which is disposed in a bottom of the tub and stores washing water, a spray arm which sprays the washing water into the tub, a washing pump which sends the washing water stored in the sump to the spray arm, and a check valve which is disposed between the sump and the washing pump and opened in a direction of the washing pump from the sump.

20 Claims, 9 Drawing Sheets

(56) References Cited

U.S. PATENT DOCUMENTS

| | | | |
|---|---|---|---|
| 2016/0073851 | A1 | 3/2016 | Thiyagarajan et al. |
| 2017/0188778 | A1 | 7/2017 | Kim et al. |

FOREIGN PATENT DOCUMENTS

| | | |
|---|---|---|
| EP | 2954828 | 12/2015 |
| JP | S56106633 | 8/1981 |
| JP | S6070268 | 5/1985 |
| KR | 1020070099358 | 10/2007 |
| KR | 101202062 | 11/2012 |
| WO | WO2016028049 | 2/2016 |
| WO | WO2017022974 | 2/2017 |
| WO | WO2018174515 | 9/2018 |

OTHER PUBLICATIONS

EP Extended European Search Report in European Appln. No. 18191779.0, dated Jan. 29, 2019, 12 pages.

PCT International Search Report in International Appln. No. PCT/KR2018/010051, dated Dec. 21, 2019, 3 pages (with English translation).

DISHWASHER

CROSS-REFERENCE TO RELATED APPLICATION

This application is a continuation of U.S. application Ser. No. 16/118,728, filed on Aug. 31, 2018, which claims the priority benefit of Korean Patent Application No. 10-2017-0111511, filed on Aug. 31, 2017, in the Korean Intellectual Property Office, the disclosures of which are incorporated herein by reference in their entirety.

FIELD

The present invention relates to a dishwasher, and more particularly, to a dishwasher for washing the dishes and the cooking utensils by spraying washing water and steam.

BACKGROUND

A dishwasher is a household appliance for washing up dirt such as food wastes on the dishes or the cooking utensils (hereinafter, referred to as 'washing object') by high-pressure washing water sprayed from a spray arm.

The dishwasher generally includes a tub forming a washing chamber and a sump mounted on the bottom of the tub to store the washing water. Then, the washing water is moved to the spray arm by the pumping operation of a washing pump installed inside the sump, and the washing water moved to the spray arm is sprayed at high pressure through a spray hole formed in the spray arm. Then, the washing water sprayed at a high pressure impinges against the surface of the washing object, so that the dirt on the washing object falls to the bottom of the tub.

Meanwhile, the dishwasher performs washing of the washing object by using a heated washing water or performs sterilization by supplying steam to the washing object. Conventional dishwashers generally generate hot water or steam by heating washing water stored in the sump through a heater provided inside the sump. In this case, since the heater should be exposed to the inside of the sump to contact the washing water, the water level inside the sump should be controlled so that the heater is not exposed to prevent overheating of the heater. In addition, since the heat transfer is possible only when the heater is in contact with the washing water, there exists a problem in that the heat exchange efficiency is lowered as foreign matter adheres to the surface of the heater and durability is deteriorated as the surface of the heater is corroded.

In order to overcome such disadvantages, a dishwasher in which a heater is installed on a washing pump has recently been proposed. In this case, the heater inside the washing pump heats the washing water to generate hot water or steam. Accordingly, the washing pump should be capable of temporarily storing the washing water, and the steam should not flow out through a flow path through which the washing water flows.

SUMMARY

The present invention has been made in view of the above problems, and provides a dishwasher in which steam can be generated in a washing pump and steam is not lost.

In accordance with an aspect of the present invention, a dishwasher includes: a tub which accommodates a washing object; a sump which is disposed in a bottom of the tub and stores washing water; a spray arm which sprays the washing water into the tub; a washing pump which sends the washing water stored in the sump to the spray arm; and a check valve which is disposed between the sump and the washing pump and opened in a direction of the washing pump from the sump.

The check valve allows the washing water to flow from the sump to the washing pump.

The check valve is opened by rotating a lower portion thereof around an upper portion thereof.

The dishwasher further includes a heater for heating the washing water in the washing pump to generate steam, and the check valve is closed when the heater generates steam.

The heater is coupled to a lower side of the washing pump.

The washing pump includes a rotatable impeller for flowing the washing water, and the check valve is opened when the impeller rotates.

The check valve is closed when the impeller does not rotate.

The washing pump includes a motor for generating a rotational force for sending the washing water, and the check valve is opened when the motor is operated.

The dishwasher further includes a draining pump for draining the washing water stored in the sump to the outside, and the check valve is configured to allow the washing water to flow from the washing pump to the sump during operation of the draining pump.

The washing pump includes: a housing; and a washing water intake pipe through which the washing water flows into the housing, and the check valve is configured such that a part of a lower portion of the washing water intake pipe is opened when the check valve is closed.

An upper end of the check valve is coupled to an upper end of the washing water intake pipe.

The check valve is configured to block 50% to 90% of a cross-sectional area of the washing water intake pipe when it is closed.

The washing pump includes: a housing; and a washing water intake pipe through which the washing water flows into the housing, and the check valve includes: a valve body which opens and closes the washing water intake pipe; and a valve support which supports the valve body and is coupled to the washing water intake pipe.

The valve body is formed in a circular segment shape.

The valve body is provided with a thin folding portion so that a lower portion thereof is folded.

The valve support is provided with a protruded hinge member, and an upper portion of the valve body has a hinge hole through which the hinge member passes.

In accordance with another aspect of the present invention, a dishwasher includes: a tub which accommodates a washing object; a sump which is disposed in a bottom of the tub and stores washing water; a spray arm which sprays the washing water into the tub; a washing pump which sends the washing water stored in the sump to the spray arm; a heater which heats the washing water to generate steam; and a check valve which is disposed between the sump and the washing pump and is closed so that the washing water does not flow from the washing pump to the sump when the steam is generated by the heater.

The heater is coupled to a lower side of the washing pump and heats the washing water stored in the washing pump to generate steam.

The washing pump includes a motor for generating a rotational force for sending the washing water, and the check valve is closed when the motor is stopped so that the washing water is stored in the washing pump.

The dishwasher further includes a draining pump for draining the washing water stored in the sump to the outside, and the check valve is closed when the draining pump is stopped so that the washing water is stored in the washing pump.

BRIEF DESCRIPTION OF THE DRAWINGS

The objects, features and advantages of the present invention will be more apparent from the following detailed description in conjunction with the accompanying drawings, in which.

DETAILED DESCRIPTION

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Hereinafter, the present invention will be described with reference to the drawings for explaining a dishwasher according to embodiments of the present invention.

Figure 1:
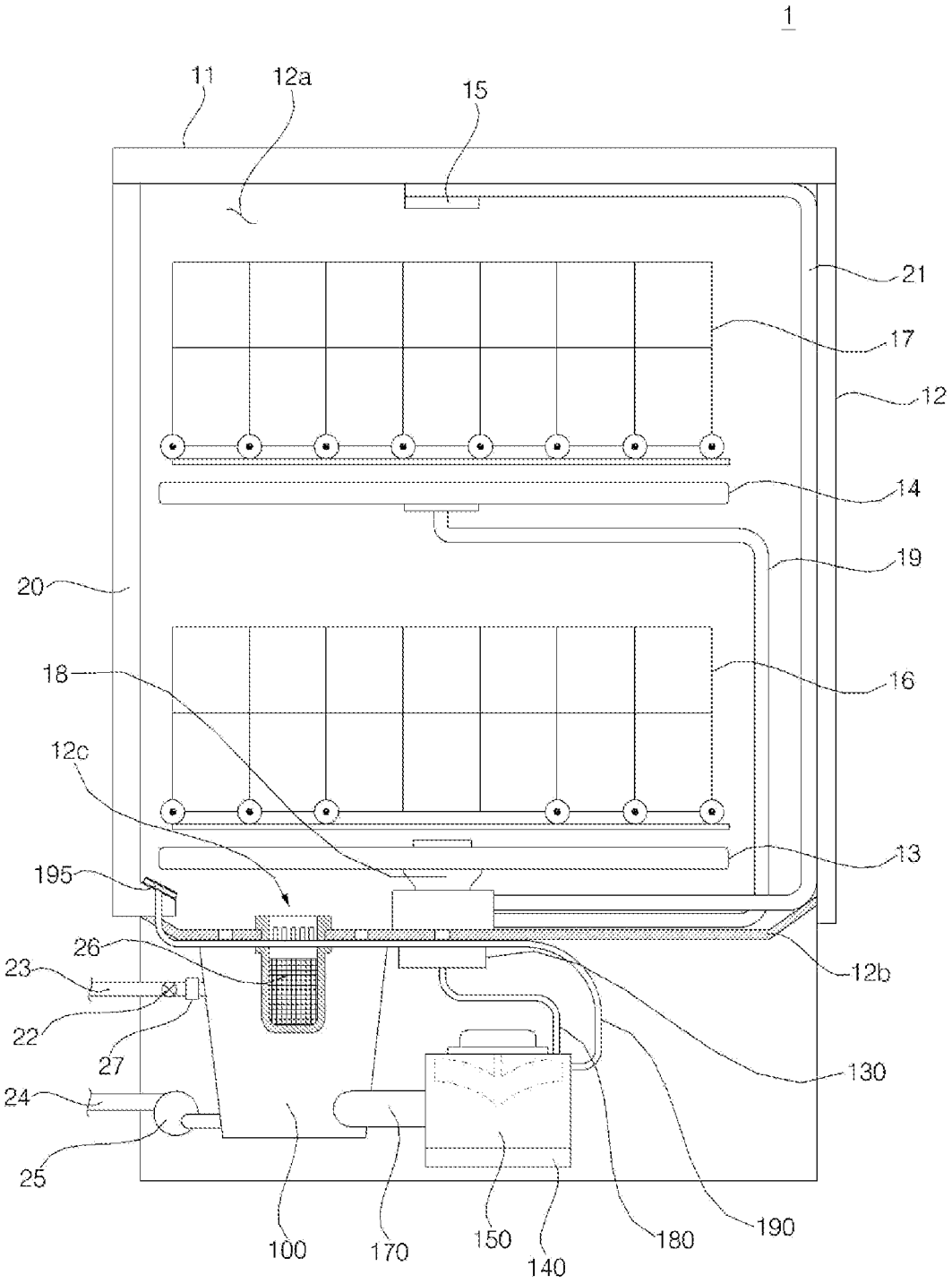
FIG. 1 is a schematic structural view of a dishwasher according to an embodiment of the present invention.
Figure 2:
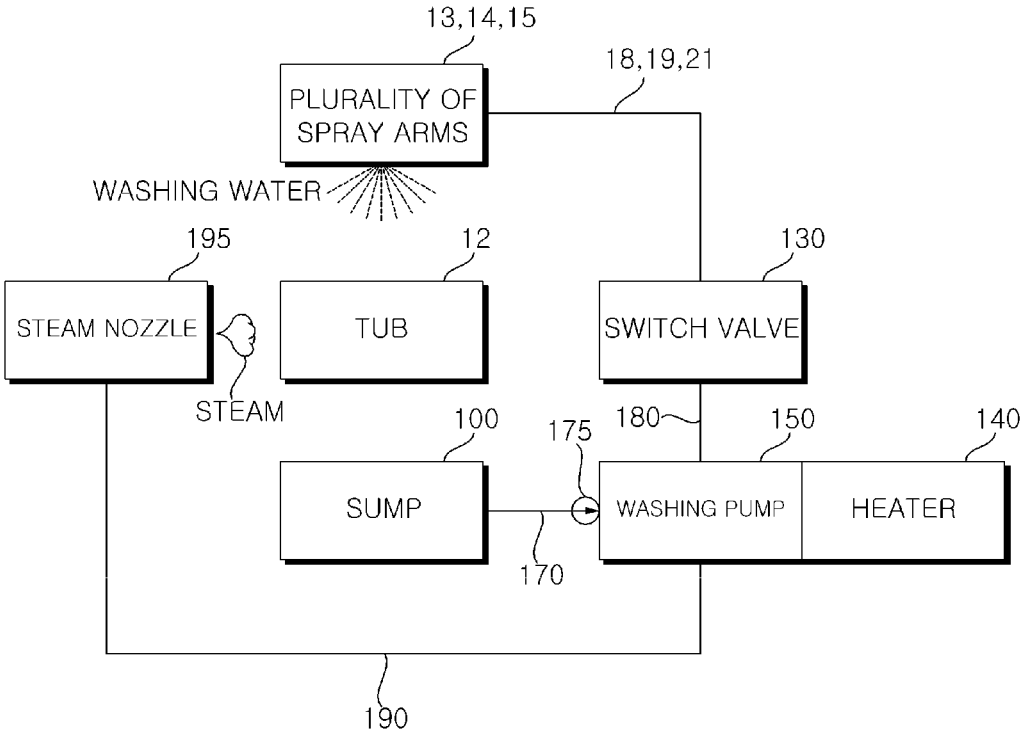
FIG. 2 is a configuration view of a dishwasher according to an embodiment of the present invention.

FIG. 1 is a schematic structural view of a dishwasher according to an embodiment of the present invention, and FIG. 2 is a configuration view of a dishwasher according to an embodiment of the present invention.

The dishwasher 1 according to an embodiment of the present invention includes a case 11 that forms an outer appearance, a tub 12 that is provided inside the case 11 and forms a washing chamber 12*a* in which a washing object is accommodated, a door 20 that is provided on the front surface of the tub 12 and opens and closes the washing chamber 12*a*, a sump 100 that is disposed below the tub 12 and stores washing water, a plurality of spray arms 13, 14, 15 that spray washing water into the tub 12, a washing pump 150 that sends washing water stored in the sump 100 to the plurality of spray arms 13, 14, 15, a heater 140 that heats the washing water inside the washing pump 150, and a check valve 175 that is disposed between the sump 100 and the washing pump 150 and opened to allow the washing water to flow from the sump 100 to the washing pump 150.

The tub 11 is formed in a hexahedron shape having an opened front surface and forms a washing chamber 12*a* therein. A communication hole 12*c* through which the washing water flows into the sump 100 is formed in a bottom 12*b* of the tub 11. The washing chamber 12*a* is provided with a plurality of racks 16 and 17 for receiving the washing object. The plurality of racks 16 and 17 include a lower rack 16 disposed at a lower portion of the washing chamber 12*a* and an upper rack 17 disposed at an upper portion thereof. The lower rack 16 and the upper rack 17 are vertically spaced apart and can be slid forwardly of the tub 11 to be drawn out.

The plurality of spray arms 13, 14, and 15 are disposed in the vertical direction. The plurality of spray arms 13, 14, and 15 include a lower spray arm 13 which is disposed in the lowermost end and sprays washing water from the lower side to the upper side toward the lower rack 16, an upper spray arm 14 which is disposed in the upper side of the lower spray arm 13 and sprays washing water from the lower side to the upper side toward the upper rack 17, and a top spray arm 15 which is disposed in the upper end of the washing chamber 12*a* that is above the upper spray arm 14 and sprays washing water from the upper side to the lower side.

The plurality of spray arms 13, 14, and 15 are supplied with the washing water from the washing pump 150 through a plurality of spray arm connecting flow paths 18, 19, and 21. The plurality of spray arm connecting flow paths 18, 19, and 21 include a lower spray arm connecting flow path 18 connected to the lower spray arm 13, an upper spray arm connecting flow path 19 connected to the upper spray arm 14, and a top spray arm connecting flow path 21 connected to the top spray arm 15.

The sump 100 is disposed below the bottom 12*b* of the tub 12 to collect washing water. The sump 100 is connected to a water supply flow path 23 through which washing water supplied from an external water source flows. The water supply flow path 23 is provided with a water supply valve 22 for controlling washing water supplied from the external water source. When the water supply valve 22 is opened, the washing water supplied from the external water source flows into the sump 100 through the water supply flow path 23. The water supply flow path 23 is provided with a flow meter 27 for measuring the flow rate of the washing water flowing into the sump 100 through the water supply flow path 23.

The sump 100 is connected to a drainage flow path 24 for guiding the stored washing water to the outside of the dishwasher 1. The drainage flow path 24 is provided with a draining pump 25 for draining the washing water in the sump 100 through the drainage flow path 24. When the draining pump 25 is operated, the washing water stored in the sump 100 flows to the outside of the case 11 through the drainage flow path 24.

A filter 26 is installed in the communication hole 12*c* to filter the dirt from the washing water moving from the tub 12 to the sump 100.

The washing pump 150 sends the washing water stored in the sump 100 to at least one of the plurality of spray arms 13, 14 and 15. The washing pump 150 is connected to a switching valve 130 and a washing water supply path 180. When the washing pump 150 is operated, the washing water stored in the sump 100 flows into the washing pump 150 through a water collecting flow path 170 and is then sent to the switching valve 130 through the washing water supply flow path 180. A check valve 175 is provided inside the water collecting flow path 170 or between the water collecting flow path 170 and the washing pump 150.

The washing pump 150 is installed at one lateral side of the sump 100. The washing pump 150 is connected to a steam hose 190. The steam generated in the washing pump 150 is supplied to a steam nozzle 195 through the steam hose 190.

The heater 140 is coupled to the lower side of the washing pump 150 to heat the washing water in the washing pump 150. The heater 140 generates hot water by heating the washing water flowing in the washing pump 150 when the washing pump 150 operates. The heater 140 generates steam by heating the washing water stored in the washing pump 150 when the washing pump 150 is stopped.

The hot water generated by the heater 140 is sprayed into the tub 12 through at least one of the plurality of spray arms 13, 14, and 15. The steam generated by the heater 140 flows along the steam hose 190 and is discharged into the tub 12 through the steam nozzle 195.

The steam nozzle 195 is provided at the lower end of the door 20 to discharge the steam generated by the heater 140 to the washing chamber 12*a*. The steam discharged from the steam nozzle 195 is applied to the washing object accommodated in the lower rack 16 and/or the upper rack 17.

The switching valve 130 selectively connects the sump 100 to at least one of the plurality of spray arms 13, 14, and 15. The switching valve 130 selectively supplies the washing water sent by the washing pump 150 to at least one of the lower spray arm 13, the upper spray arm 14, and the top spray arm 15. The switching valve 130 selectively connects the washing water supply flow path 180 and at least one of the plurality of spray arm connecting flow paths 18, 19, and 21. The switching valve 130 is disposed in the sump 100.

The check valve 175 is disposed between the sump 100 and the washing pump 150 and is opened in the direction of the washing pump 150 from the sump 100. The check valve 175 is opened to allow the washing water to flow from the sump 100 to the washing pump 150 and is closed to allow the steam not to flow from the washing pump 150 to the sump 100. The check valve 175 is opened by rotating the lower portion around the upper portion. The check valve 175 is disposed inside the water collecting flow path 170 or connected between the water collecting flow path 170 and the washing pump 150 to open and close the water collecting flow path 170.

The check valve 175 is closed when the heater 140 generates steam. The check valve 175 is opened when the washing pump 150 operates to flow the washing water, and is closed when the washing pump 150 stops and the washing water does not flow. The check valve 175 is opened by the flow pressure of the washing water of the washing pump 150. According to an embodiment, the check valve 175 may be a solenoid valve that is opened or closed by an electronic signal.

The check valve 175 is formed to allow the washing water to flow from the washing pump 150 to the sump 100 even when it is closed during operation of the draining pump 25.

Figure 3:
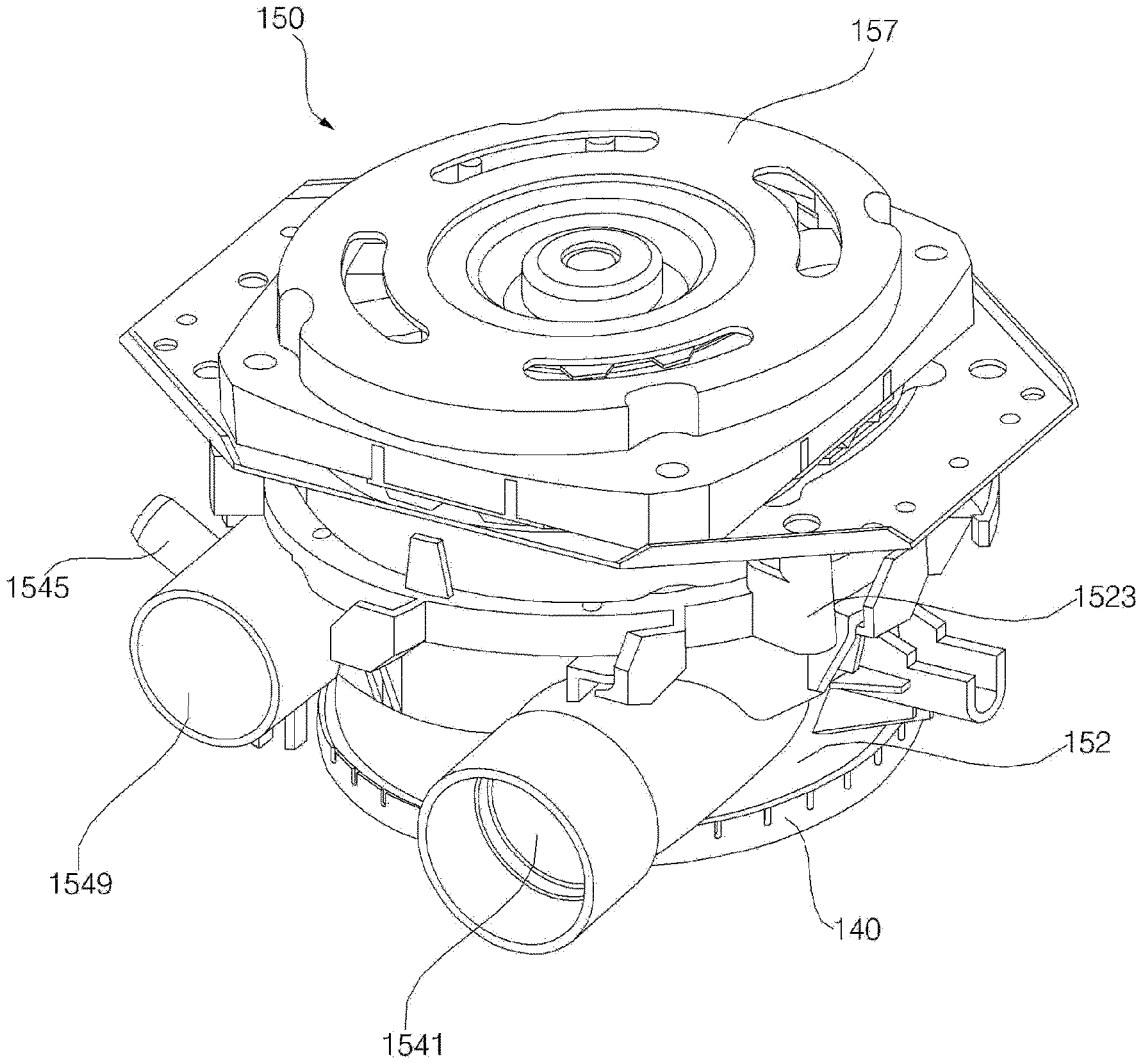
FIG. 3 is a perspective view of a washing pump according to an embodiment of the present invention.
Figure 4:
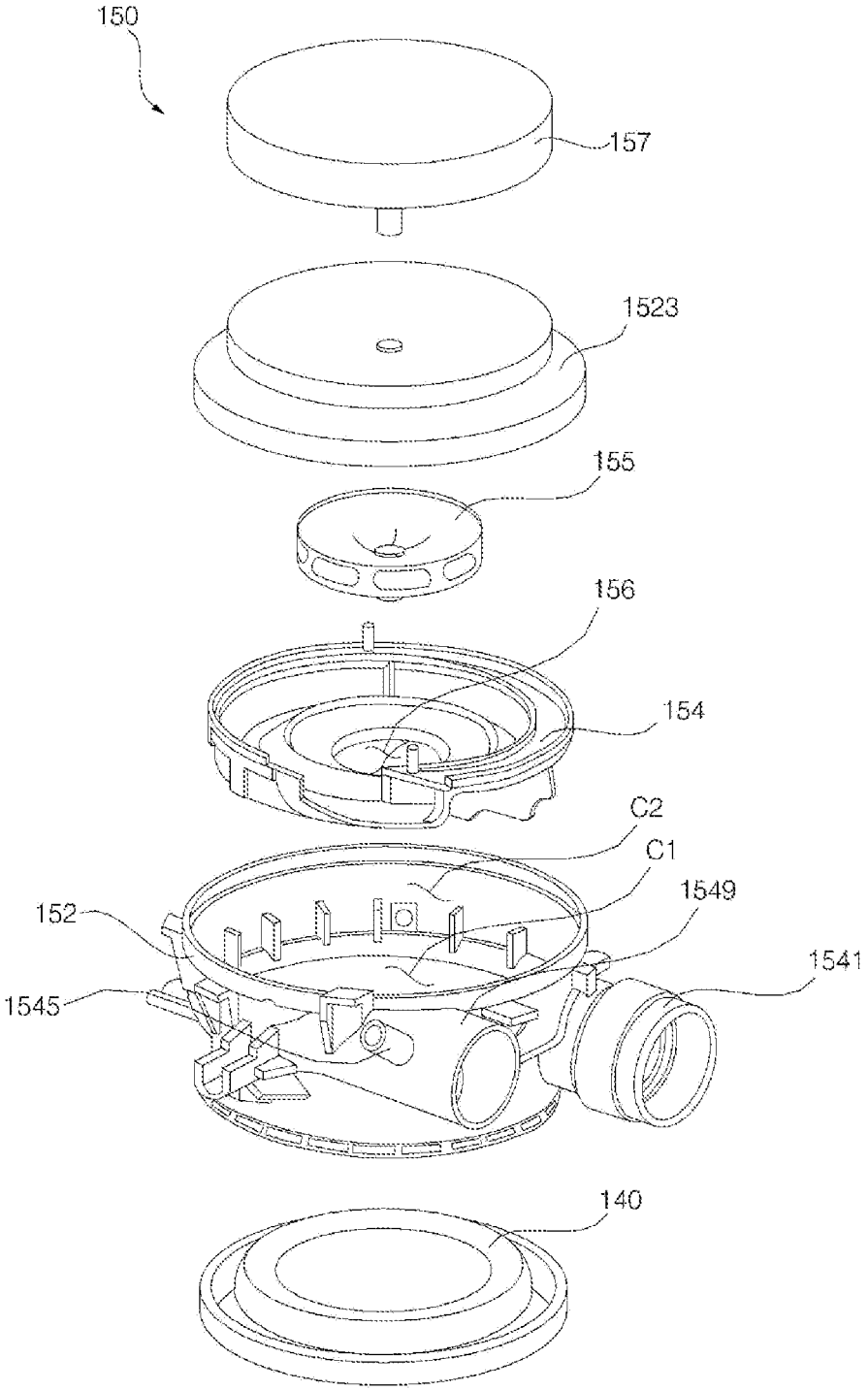
FIG. 4 is an exploded perspective view of a washing pump according to an embodiment of the present invention.
Figure 5:
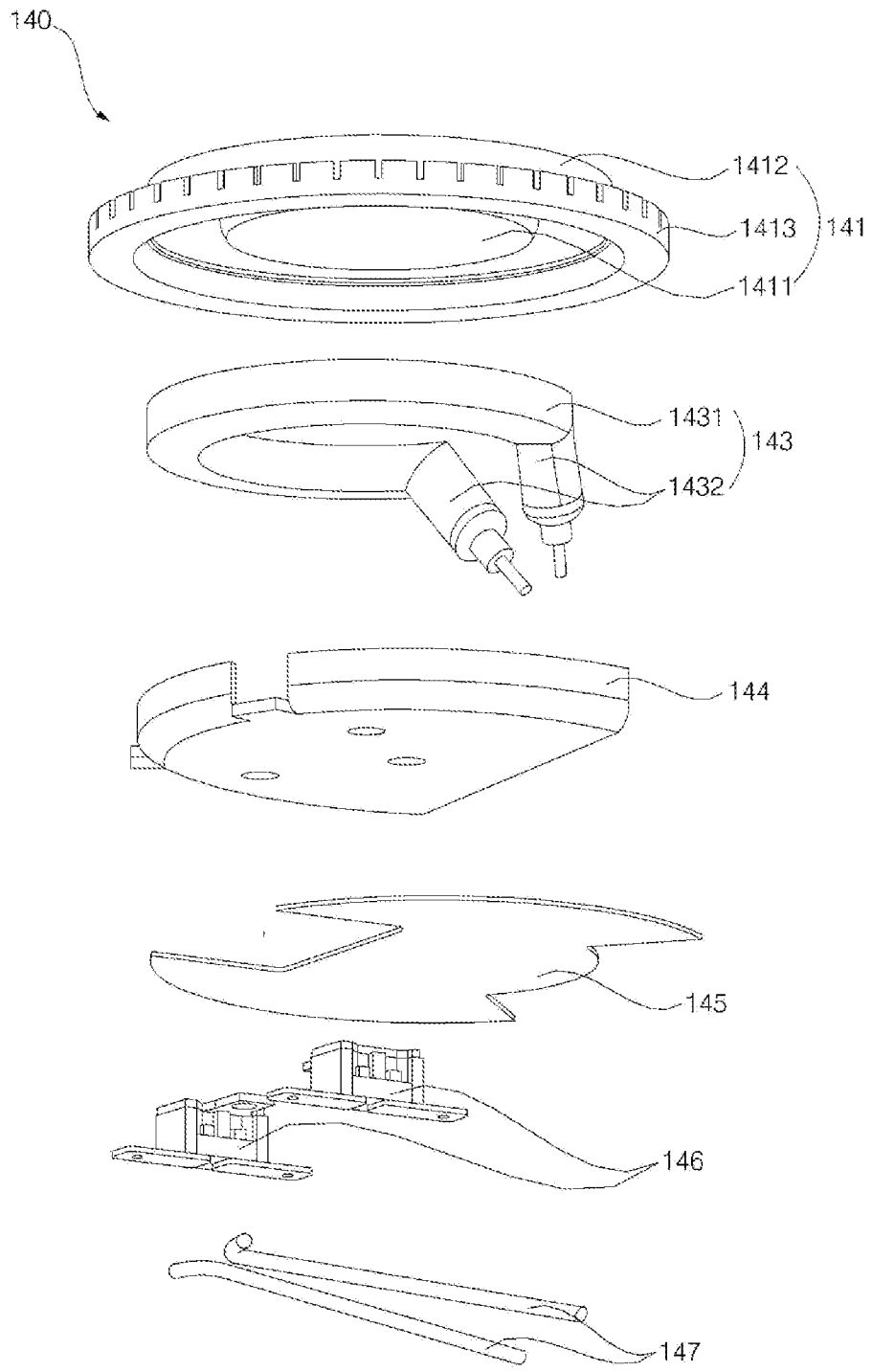
FIG. 5 is an exploded perspective view of a heater according to an embodiment of the present invention.
Figure 6:
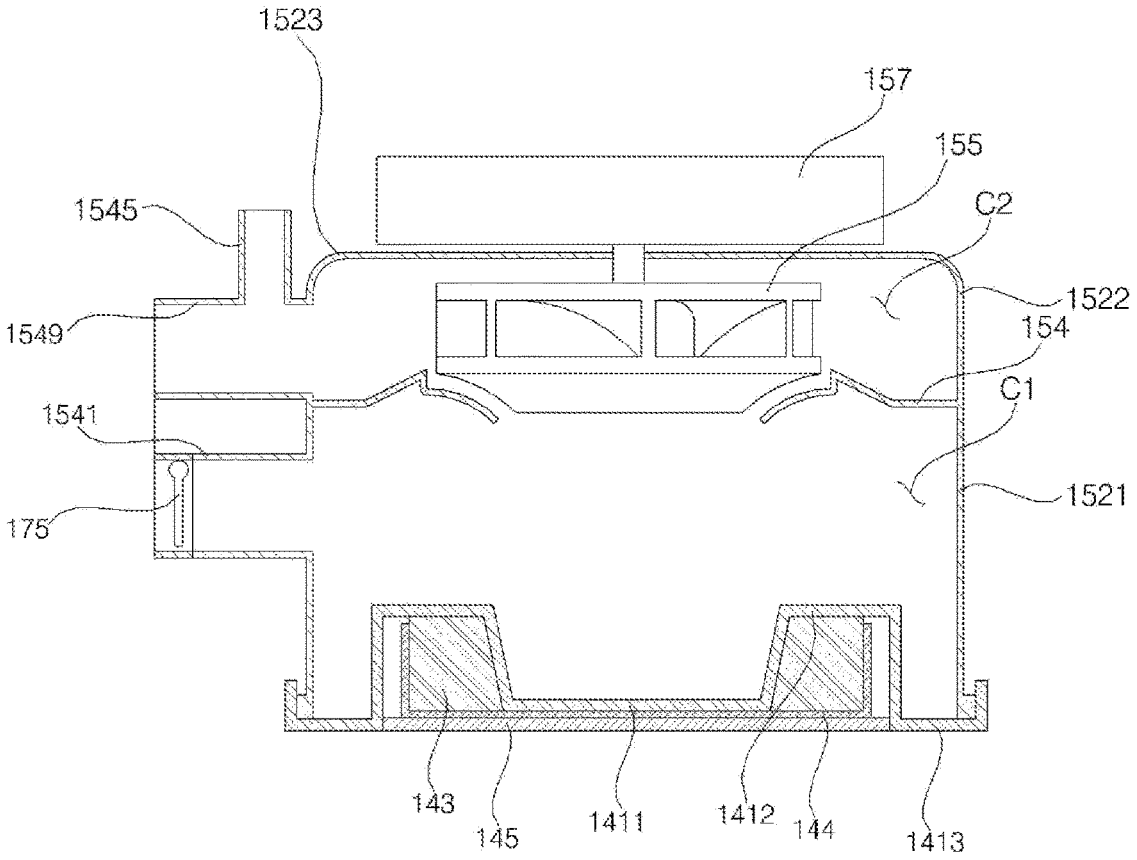
FIG. 6 is a schematic cross-sectional view of a washing pump according to an embodiment of the present invention.

FIG. 3 is a perspective view of a washing pump according to an embodiment of the present invention, FIG. 4 is an exploded perspective view of a washing pump according to an embodiment of the present invention, FIG. 5 is an exploded perspective view of a heater according to an embodiment of the present invention, and FIG. 6 is a schematic cross-sectional view of a washing pump according to an embodiment of the present invention.

The washing pump 150 according to an embodiment of the present invention includes a cylindrical housing 152 which is coupled to the sump 100, a washing water intake pipe 1541 which is connected to the housing 152 and through which the washing water flows into the housing 152 by the rotation of an impeller 155, a washing water outflow pipe 1549 which is connected to the housing 152 and through which the washing water is discharged to the outside of the housing 152 by the rotation of the impeller 155, a rotatable impeller 155 which is disposed inside the housing 152 and sends the washing water introduced into the washing water intake pipe 1541 to the washing water outflow pipe 1549, a motor 157 which rotates the impeller 155, and a steam discharge pipe 1545 disposed in the wash water outflow pipe 1549 and discharges steam generated by the heater 140.

The housing 152 is formed in a cylindrical shape having opened top and bottom surfaces. The housing 152 is coupled to the sump 100. A housing cover 1523 is coupled to the upper end of the housing 152, and the heater 140 is coupled to the lower end thereof. The housing cover 1523 covers the upper portion of the housing 152, and the housing cover 1523 is provided with a motor 157 for rotating the impeller 155 by generating a rotational force.

A partition wall 154 is disposed inside the housing 152. The partition wall 154 is disposed at the middle end of the housing 152 to divide an internal space vertically. The partition wall 154 is disposed below the impeller 155. The partition wall 154 is disposed above the washing water intake pipe 1541 and disposed below the washing water outflow pipe 1549. The partition wall 154 forms a lower chamber C1 and an upper chamber C2 inside the housing 152. The lower chamber C1 is the place where a negative pressure is generated by the rotation of the impeller 155 and the upper chamber C2 is the place where the impulse 155 is accommodated and a positive pressure is generated by the rotation of the impeller 155. The lower chamber C1 is connected to the sump 100 through the water collecting flow path 170 and the washing water intake pipe 1541. The upper chamber C2 is connected to the switching valve 130 through the washing water outflow pipe 1549 and the washing water supply flow path 180. In addition, it is connected to the steam nozzle 195 through the steam discharge pipe 1545 and the steam hose 190.

The partition wall 154 divides the washing pump 150 into a pump lower portion 1521 through which the washing water is introduced by the rotation of the impeller 155 and a pump upper portion 1522 through which the washing water is discharged by the rotation of the impeller 155. The washing water is introduced to the inside of the pump lower portion 1521, and the lower chamber C1 is formed in the inside of the pump lower portion 1521. The pump lower portion 1521 includes a lower portion of the housing 152 and the washing water intake pipe 1541. The pump lower portion 1521 may further include a heater cover 141 of the heater 140.

The pump upper portion 1522 discharges washing water or steam to the outside, and forms the upper chamber C2 therein. The pump upper portion 1522 includes an upper portion of the housing 152, the washing water outflow pipe 1549, the steam discharge pipe 1545, and the housing cover 1523. The impeller 155 is disposed inside the pump upper portion 1522 and the motor 157 is disposed in the upper side of the pump upper portion 1522.

The partition wall 154 includes a partition hole 156 for communicating the lower chamber C1 and the upper chamber C2. The upper surface of the upper chamber C2 side of the partition wall 154 is formed in a volute shape so that the washing water introduced to the upper chamber C2 through the partition hole 156 from the lower chamber C1 is guided to the washing water outflow pipe 1549. A guider (not shown) protruding downward is formed on the lower surface of the lower chamber C1 side of the partition wall 154. The guider of the partition wall 154 guides the washing water introduced into the lower chamber C1 through the washing water intake pipe 1541 to the partition wall hole 156. The guider of the partition wall 154 allows the washing water in the lower chamber C1 to be uniformly heated by the heater 140.

The impeller 155 is rotated by the motor 157 and flows the washing water in the housing 152 to send to the outside. The impeller 155 is rotatably disposed in the upper chamber C2. The impeller 155 sends the washing water introduced into the upper chamber C2 from the lower chamber C1 through the partition hole 156 to the washing water outflow pipe 1549.

The washing water intake pipe 1541 is connected to the lower chamber C1 side of the housing 152. The washing water intake pipe 1541 is connected to the water collecting flow path 170 to allow the washing water of the sump 100 to flow into the lower chamber C1. The washing water intake pipe 1541 is disposed to protrude outward from the lower sidewall of the housing 152. The washing water intake pipe 1541 is disposed in such a manner that the pipe direction is horizontal, so that the washing water flows in the horizontal direction.

The washing water outflow pipe 1549 is connected to the upper chamber C2 side of the housing 152. The washing water outflow pipe 1549 is connected to the washing water supply flow path 180 so that the washing water in the upper chamber C2 is discharged to the washing water supply flow path 180. The washing water outflow pipe 1549 is disposed to protrude outward from the upper side wall of the housing 152. The washing water outflow pipe 1549 is horizontally disposed so that the outflow direction of the washing water is horizontal. The washing water outflow pipe 1549 is disposed higher than the washing water inflow intake pipe 1541. The outflow direction of the washing water of the washing water outflow pipe 1549 is parallel to the intake direction of the washing water of the washing water intake pipe 1541, but opposite to each other.

The steam discharge pipe 1545 is connected to the upper chamber C2 side of the housing 152. The steam discharge pipe 1545 is disposed above the partition wall 154. The steam discharge pipe 1545 may be disposed at various positions of the housing 152 so as to connect the upper chamber C2 of the housing 152 and the steam hose 190. In the present embodiment, the steam discharge pipe 1545 is disposed in the washing water outflow pipe 1549. The steam discharge pipe 1545 is disposed to be inclined so that the steam discharge direction is inclined upward. The steam discharge direction of the steam discharge pipe 1545 is perpendicular to the washing water discharge direction of the washing water outflow pipe 1549.

The steam discharge pipe 1545 is connected to the steam hose 190 and discharges the steam generated in the housing 152 by the heater 140 to the steam hose 190. The steam hose 190 is connected to the upper chamber C2 through the steam discharge pipe 1545.

The heater 140 is connected to the lower end of the housing 152 to form a bottom surface of the housing 152. The heater 140 heats the washing water flowing inside the housing 152 when the impeller 155 rotates. The heater 140 generates steam by heating the washing water stored in the housing 152 when the impeller 155 stops. The heater 140 is disposed below the washing water intake pipe 1541. The heater 140 is disposed below the partition wall 154. A part of the heater 140 is disposed inside the housing 152.

The check valve 175 is coupled to the washing water intake pipe 1541. The upper end of the check valve 175 is coupled to the upper end of the washing water intake pipe 1541. The check valve 175 is opened when the impeller 155 rotates and is closed when the impeller 155 does not rotate. The check valve 175 is opened when the motor 157 is operated and closed when the motor 157 is stopped. The check valve 175 is closed when the heater 140 generates steam so that the steam generated inside the housing 152 is prevented from flowing out to the sump 100 through the lower chamber C1 and the washing water intake pipe 1541.

The check valve 175 is configured to allow the washing water to flow from the washing pump 150 to the sump 100 during operation of the draining pump 25. The check valve 175 is formed in such a manner that a part of the lower portion of the washing water intake pipe 1541 is opened when it is closed. The check valve 175 is formed to block 50% to 90% of the cross-sectional area of the washing water intake pipe 1541 when it is closed, and is preferably formed to cover 70% of the cross-sectional area of the washing water intake pipe 1541.

The check valve 175 is closed to prevent the washing water and the steam from flowing from the washing pump 150 to the sump 100 when the heater 140 generates steam. The check valve 175 stores the washing water inside the housing 152 when the draining pump 25 and the motor 157 are stopped (when not operating). The heater 140 heats the washing water stored in the housing 152 by the check valve 175 to generate steam.

The heater 140 according to an embodiment of the present invention includes a heater cover 141 which forms a bottom surface of the housing 152, a heating element 143 which is joined to the lower side of the heater cover 141 and heats the heater cover 141, a heater plate 144 which is joined to the lower side of the heating element 143 and the heater cover 141 and transfers the heat of the heating element 143 to the heater cover 141, a thermostat 146 which supplies power to the heating element 143 and adjusts the temperature of the heating element 143, a wire 147 which electrically connects the heating element 143 and the thermostat 146, and a heater shield 145 which covers a part of the heater plate 144 from the lower side.

The heater cover 141 is coupled to the lower end of the housing 152 and forms the bottom surface of the housing 152 of the washing pump 150. The upper surface of the heater cover 141 is in contact with the washing water. The heater 143 and the heater plate 144 are joined to the lower side of the heater cover 141. The heater cover 141 is heated by the heating element 143 and the heater plate 144 to heat the washing water.

The circumference of the heater cover 141 is formed in a circular shape, and a plurality of bends in a vertical direction are formed at the position of concentric circle.

The heater cover 141 is partly annularly protruded upward (toward the partition wall 154 side of the washing pump 150). A part of the heater cover 141 protrudes inward of the housing 152 to form an annular space in which a part of the heating element 143 is accommodated. A part of the heater cover 141 is disposed between the washing water accommodated in the housing 152 and the heating element 143. Thus, the heating element 143 is not in contact with the washing water accommodated in the housing 152.

The heater cover 141 includes a cover base 1411 having a disk shape, a cover holder 1412 protruding upward from the circumference of the cover base 1411, and a cover rim 1413 which is formed around the cover holder 1412 and is coupled with the housing 152.

The cover base 1411 is formed of a circular plate and forms a central portion of the heater cover 141. The central portion of the heater plate 144 is joined to the lower side of the cover base 1411. The cover base 1411 and the central portion of the heater plate 144 are joined by brazing.

The cover holder 1412 is formed in a ring shape protruding upward. The cover holder 1412 forms an annular space in which a part of the heating element 143 is accommodated. In the annular space of the cover holder 1412, a heating main body 1431 of heating element 143 described later is accommodated. A part of the heating element 143 is joined to the inside of the cover holder 1412. The cover holder 1412 and a part of the heating element 143 are joined by brazing.

The longitudinal section from the center to the radial direction of the cover holder 1412 is formed in an open curve whose lower side is open. At least part of the cover holder 1412 is formed to correspond to a part of the shape of the heating element 143 accommodated in the annular space of the cover holder 1412. The cover holder 1412 accommodates a part of the heating element 143 and is in direct contact with a part of the heating element 143. The inner surface of the outer circumference of the cover holder 1412 is spaced apart from the outer circumferential surface of a part of the heating element 143 accommodated in the annular space of the cover holder 1412.

The cover rim 1413 is formed in a rim shape. The cover rim 1413 is formed to surround the lower end of the housing 152. The circumferential end of the cover rim 1413 protrudes upward and is coupled with the housing 152. Since the cover rim 1413 is not in contact with the heater plate 144 and the heating element 143, it is heated to a relatively low temperature.

The heating element 143 receives power from the thermostat 146 through a wire 147 and generates heat. The heating element 143 heats the heater cover 141 and the heater plate 144. The heater cover 141 is joined to the upper side of the heating element 143 by brazing, and the heater plate 144 is joined to the lower side thereof by brazing.

The outer circumference of a part of the heating element 143 is spaced apart from the portion of the heater cover 141 forming an annular space. A part of the heating element 143 is accommodated in the annular space formed in the heater cover 141 and disposed inside the housing 152. The heating element 143 is disposed below the heater cover 141 forming the bottom surface of the housing 152 and disposed in the outside of the washing pump 150 but partially disposed in the inside of the housing 152.

The heating element 143 includes an arc-shaped heating main body 1431 for generating heat and a heating terminal 1432 for supplying power to the heating main body 1431.

The heating main body 1431 is formed in an arc shape whose center angle is larger than 180 degrees. The heating main body 1431 is accommodated inside the cover holder 1412. The upper surface and the inner circumferential surface of the heating main body 1431 come into contact with the heater cover 141 to heat the heater cover 141. The lower surface and the outer circumferential surface of the heating main body 1431 are brought into contact with the heater plate 144 to heat the heater plate 144. The heating main body 1431 is disposed higher than the lower end of the housing 152.

The heating terminal 1432 receives power from the thermostat 146 through the wire 147 and transfers the power to the heating main body 1431. A plurality of heating terminals 1432 are provided at both ends of the heating main body 1431. The plurality of heating terminals 1432 are extended from both ends of the heating main body 1431 and formed to be inclined downward. That is, the plurality of heating terminals 1432 are formed to protrude downward from a plane formed by the lower end of the heating main body 1431.

The heater plate 144 is heated by the heating element 143 to heat the cover base 1411 of the heater cover 141. The heater plate 144 uniformly distributes the heat of the heating element 143 to uniformly heat the heater cover 141. The heater plate 144 is formed in a bowl shape. The circumferential inner surface of the heater plate 144 is in contact with the heating element 143, but the circumferential outer surface thereof is spaced apart from the heater cover 141. A heater shield 145 is disposed below the heater plate 144.

Figure 7:
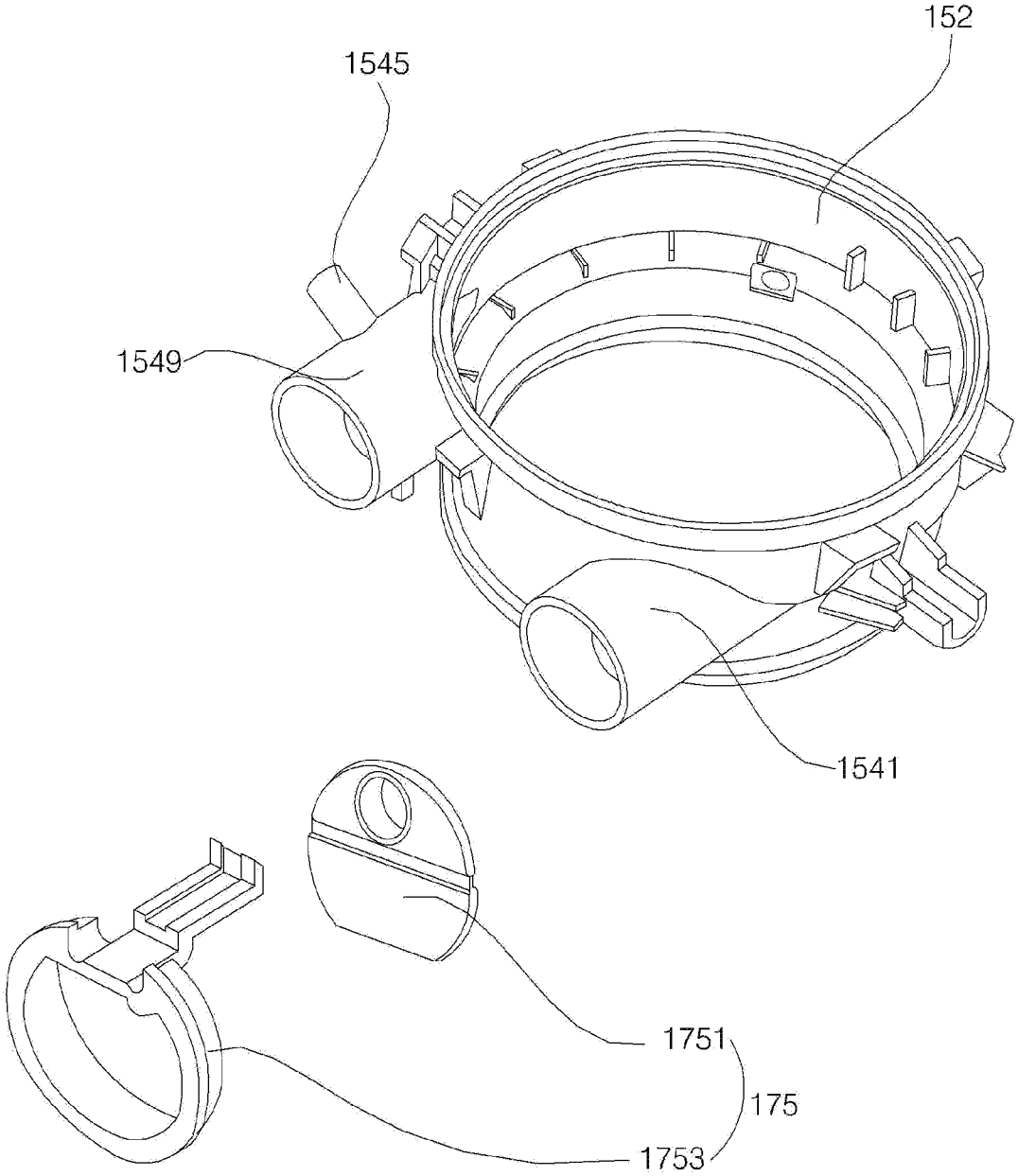
FIG. 7 is an exploded perspective view of a part of a washing pump and a check valve according to an embodiment of the present invention.
Figure 8:
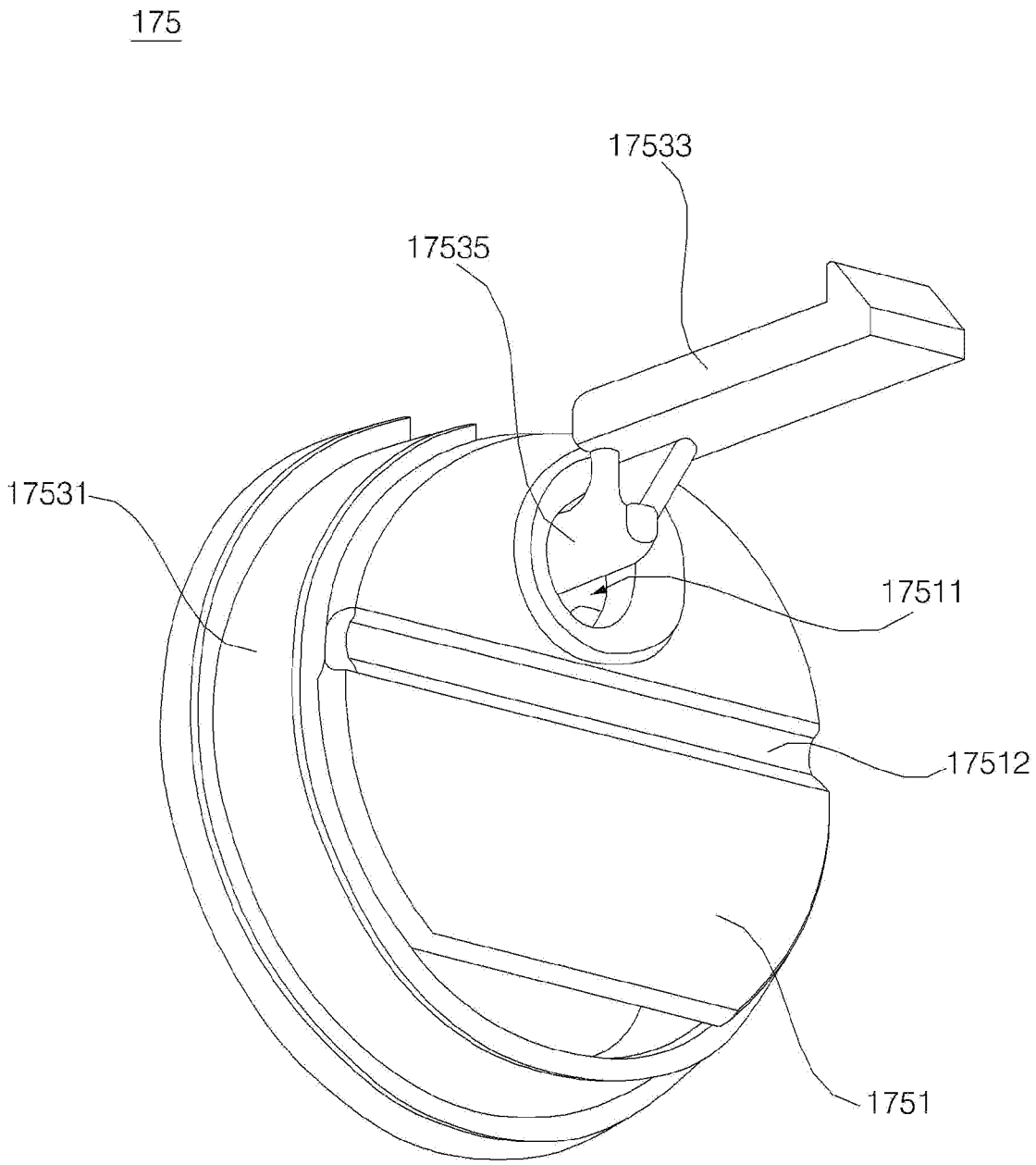
FIG. 8 is a perspective view of a check valve according to an embodiment of the present invention.
Figure 9:
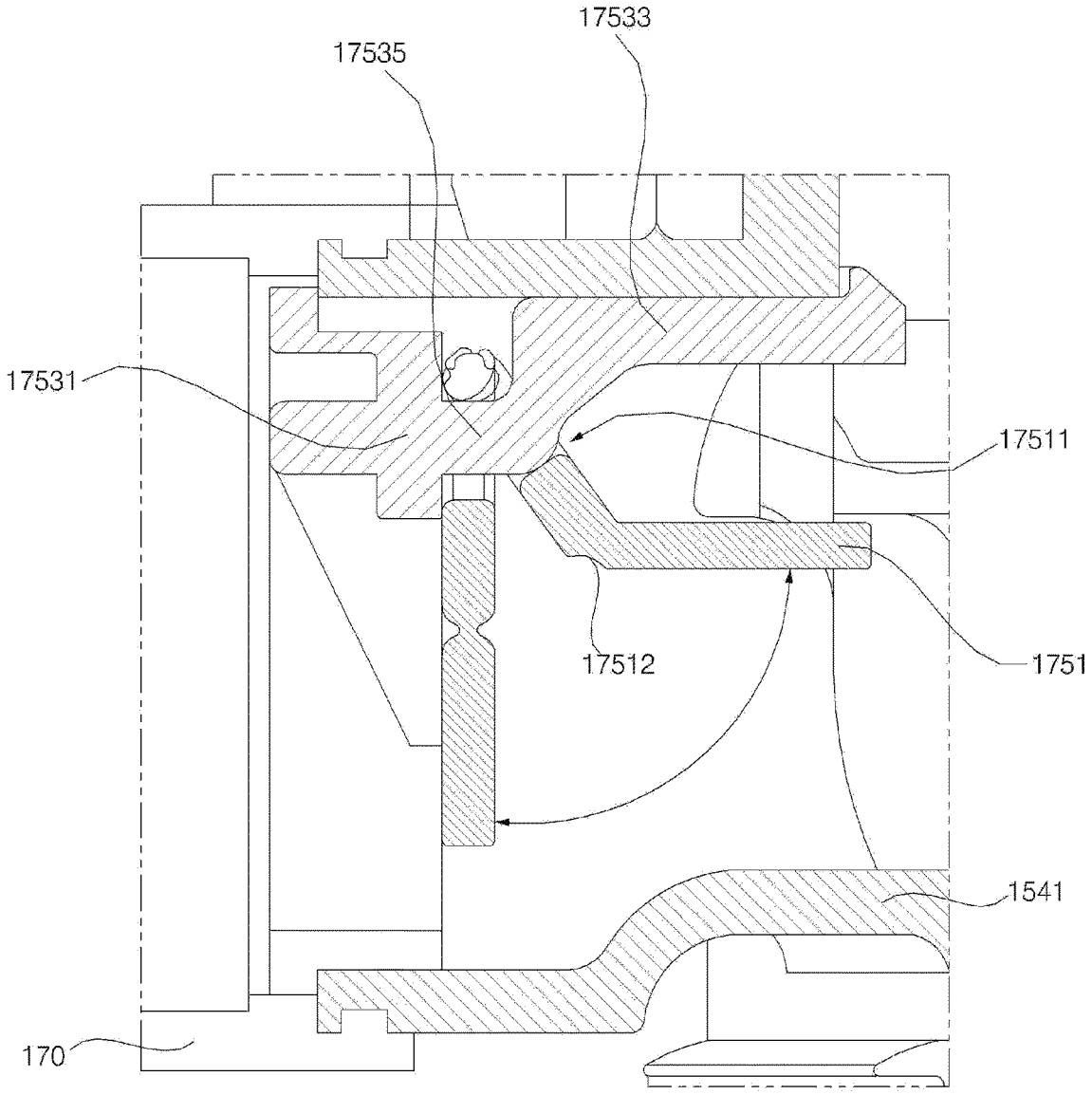
FIG. 9 is a cross-sectional view of a check valve according to an embodiment of the present invention.

FIG. 7 is an exploded perspective view of a part of a washing pump and a check valve according to an embodiment of the present invention, FIG. 8 is a perspective view of a check valve according to an embodiment of the present invention, and FIG. 9 is a cross-sectional view of a check valve according to an embodiment of the present invention.

The check valve 175 according to an embodiment of the present invention includes a valve body 1751 that opens and closes the washing water intake pipe 1541 and a valve support 1753 that supports the valve body 1751 and is coupled to the washing water intake pipe 1541.

The valve body 1751 is formed to be rotatable to open and close the washing water intake pipe 1541. When the valve body 1751 is opened, a part of the valve body 1751 is rotated in the inside direction of the washing water intake pipe 1541 (in the direction of the lower chamber C1). The valve body 1751 is formed in a circular segment shape so as not to completely block the washing water intake pipe 1541. The valve body 1751 is formed in a circular shape in which a part of a lower portion thereof is cut so that a part of a lower portion of the washing water intake pipe 1541 is opened when the valve body 1751 is closed. The valve body 1751 is formed in a circular segment shape having an area reduced by 10% to 50%, preferably, by 30%, in comparison with an area of a circular shape. When the draining pump 25 operates, the washing water in the housing 152 of the washing pump 150 flows into the water collecting flow path 170 through a gap between the lower end of the valve body 1751 and the lower portion of the washing water intake pipe 1541. When generating steam, preferably, the water level of the washing water stored in the housing 152 of the washing pump 150 is higher than the lower end of the valve body 1751.

The valve body 1751 is provided with a hinge hole 17511 through which a part of the valve support 1753 (a hinge member 17535 to be described later) is passed. The hinge hole 17511 is formed at the upper end of the valve body 1751 so that the valve body 1751 can be rotated. The valve body 1751 is provided with a thin folding portion 17512 so that the lower portion thereof is folded. The valve body 1751 is folded based on the folding portion 17512 when it is opened.

The valve support 1753 supports the valve body 1751 so that the valve body 1751 can be rotated. The valve support 1753 is coupled with the washing water intake pipe 1541 so that the valve body 1751 is disposed to be rotatable in the washing water intake pipe 1541.

The valve support 1753 includes a body member 17531 of a ring shape, a hinge member 17535 which protrudes from the upper end of the body member 17531, and an engaging member 17533 which extends from the hinge member 17535 and is coupled to the washing water intake pipe 1541.

The body member 17531 is formed in a ring shape so that the circumference of the valve body 1751 is seated when the valve body 1751 is closed. The body member 17531 is inserted into the washing water intake pipe 1541 and/or the water collecting flow path 170.

The hinge member 17535 protrudes from the upper end of the valve support 1753 in a direction perpendicular to the opened surface of the valve support 1753. The hinge member 17535 protrudes in the inside direction (in the direction of the lower chamber C1) of the washing water intake pipe 1541. The hinge member 17535 passes through the hinge hole 17511 of the valve body 1751.

The engaging member 17533 is bent upward from the hinge member 17535 and then protrudes and is coupled to the washing water intake pipe 1541. A hook is formed at the end of the engaging member 17533 to be coupled to the washing water intake pipe 1541.

According to the dishwasher of the present invention, one or more of the following effects can be obtained.

First, a check valve is provided between the sump and the washing pump, so that washing water for generating steam can be stored in the washing pump.

Second, a check valve is provided between the sump and the washing pump, so that the washing water is smoothly introduced into the washing pump from the sump and the steam generated in the washing pump is not lost to the sump.

Third, the washing water can flow from the washing pump to the sump when draining while the steam generated from the washing pump is not lost to the sump.

Fourth, the area reduction of the washing water flowing path can be minimized by simplifying the installation structure of the check valve.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A dishwasher comprising:

a tub;

a sump located vertically below the tub and configured to store washing water;

a spray arm configured to spray washing water to the tub;

a washing pump configured to supply washing water from the sump to the spray arm, the washing pump comprising a washing water intake pipe connected to the sump; and a check valve disposed in the washing water intake pipe and configured to control flow of washing water from the sump to the washing pump, the check valve being configured to open the washing water intake pipe by rotating in a first direction from the sump toward the washing pump and configured to close the washing water intake pipe by rotating in a second direction opposite to the first direction, wherein the check valve comprises:

a valve body configured to open and close the washing water intake pipe, the valve body comprising a folding portion configured to increase a movement range of the valve body based on the valve body rotating in the first direction, and a valve support that is coupled to the washing water intake pipe and that supports the valve body.

2. The dishwasher of claim 1, wherein the valve body comprises:

a lower valve body disposed below the folded portion; and an upper valve body disposed above the folded portion, and wherein a vertical length of the upper valve body is less than a vertical length of the lower valve body.

3. The dishwasher of claim 2, wherein a thickness of the folding portion is less than a thickness of the upper valve body or the lower valve body.

4. The dishwasher of claim 2, wherein the valve support comprises:

a valve support body having a ring shape; and a hinge that protrudes from an upper end of the valve support body, and wherein the upper valve body defines a hinge hole that receives the hinge.

5. The dishwasher of claim 4, wherein the valve support further comprises an engaging member that extends from the hinge through the hinge hole and that is coupled to the washing water intake pipe.

6. The dishwasher of claim 5, wherein the engaging member is bent upward from the hinge to an inner surface of the washing water intake pipe and extends toward the washing pump.

7. The dishwasher of claim 5, wherein the engaging member comprises a hook disposed at an end of the engaging member and coupled to the washing water intake pipe.

8. The dishwasher of claim 7, wherein an upper surface of the engaging member is in contact with an inner surface of the washing water intake pipe, and wherein the hook protrudes from an end of the upper surface of the engaging member.

9. The dishwasher of claim 1, wherein the folding portion is recessed from a surface of the valve body that faces the washing pump or the sump.

10. The dishwasher of claim 1, wherein a lower end of the valve body is spaced apart from a lower end of the valve support.

11. The dishwasher of claim 1, wherein a lower end of the valve body is configured to, based on the valve body closing the washing water intake pipe, define a space between the lower end of the valve body and the valve support.

12. The dishwasher of claim 1, wherein the valve support has a ring shape and defines a valve hole, and wherein the valve body is configured to open and close at least a portion of the valve hole.

13. The dishwasher of claim 12, wherein the valve hole has a lower portion defined below the folding portion and configured to remain open regardless of movement of the valve body with respect to the valve support.

14. The dishwasher of claim 2, wherein the upper valve body is configured to rotate by a first angle with respect to the valve support in the first direction, and wherein the lower valve body is configured to rotate by a second angle with respect to the valve support in the first direction, the second angle being greater than the first angle.

15. The dishwasher of claim 2, wherein the upper valve body is configured to rotate from the valve support to a first position in the first direction, and wherein the lower valve body is configured to, based on the folded portion folding in the first direction relative to the upper valve body, rotate from the first position to a second position that is away from the valve support relative to the first position.

16. The dishwasher of claim 1, wherein the valve body comprises a first surface facing the washing pump and a second surface facing opposite to the first surface, and wherein the folding portion is disposed at each of the first surface and the second surface.

17. The dishwasher of claim 16, wherein the folding portion is recessed from each of the first surface and the second surface.

18. The dishwasher of claim 4, wherein at least a portion of a circumference of the valve body is configured to contact the valve support body based on the valve body being closed.

19. The dishwasher of claim 18, wherein a lower portion of the circumference of the valve body is configured to be spaced apart from the valve support body based on the valve body being closed.

20. The dishwasher of claim 1, wherein the washing water intake pipe is configured to, in a state in which the check valve is closed, supply washing water from the sump to the washing pump through a space defined between a lower end of the valve body and the valve support.

* * * * *